US006726449B2

(12) United States Patent
James et al.

(10) Patent No.: US 6,726,449 B2
(45) Date of Patent: Apr. 27, 2004

(54) PUMP DIFFUSER ANTI-SPIN DEVICE

(75) Inventors: Mark Christopher James, Claremore, OK (US); Terry Wayne Shafer, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 29 days.

(21) Appl. No.: 10/100,544

(22) Filed: Mar. 18, 2002

(65) Prior Publication Data

US 2003/0185676 A1 Oct. 2, 2003

(51) Int. Cl.[7] ..... F04D 13/10
(52) U.S. Cl. ..... 415/199.2; 415/214.1; 415/224.5
(58) Field of Search ..... 415/199.2, 214.1, 415/224.5

(56) References Cited

U.S. PATENT DOCUMENTS 2,775,945 A * 1/1957 Arutunoff ..... 415/199.2
3,807,894 A * 4/1974 O'Rourke ..... 415/199.2
4,218,181 A * 8/1980 Komatsu et al. ..... 415/214.1
4,278,399 A 7/1981 Erickson
6,106,224 A 8/2000 Sheth et al.

* cited by examiner

*Primary Examiner*—Edward K. Look
*Assistant Examiner*—Igor Kershteyn
(74) *Attorney, Agent, or Firm*—Bracewell & Patterson, L.L.P.

(57) ABSTRACT

In a downhole centrifugal pump, diffusers are stacked one on top of each other inside of tubular pump housing without contacting the pump drive shaft or impellers. A first compressive device applies a pre-compressive force to a stack of diffusers to prevent the diffusers from rotating inside the tubular housing of the pump with the drive shaft. A second compressive device located between the first compressive device and the stack of diffusers applies another compressive load on the stack of diffusers in the event the first compressive device ceases to apply the compressive load.

17 Claims, 2 Drawing Sheets

PUMP DIFFUSER ANTI-SPIN DEVICE

BACKGROUND OF THE INVENTION

1. Field of the Invention

The invention relates generally to electrically driven centrifugal submersible downhole pumps, and in particular to system of using complementary compressive devices to prevent diffuser rotation.

2. Description of the Related Art

When an oil well is initially completed, the downhole pressure may be sufficient to force the well fluid up the well tubing string to the surface. The downhole pressure in some wells decreases, and some form of artificial lift is required to get the well fluid to the surface. One form of artificial lift is suspending an electric submersible pump (ESP) downhole, normally on the tubing string. The ESP provides the extra lift necessary for the well fluid to reach the surface. One type of ESP is a centrifugal pump. Centrifugal pumps have a series of impellers inside of a tubular housing, which are rotated by a drive shaft in order to propel fluids from the radial center of the pump towards the tubular housing enclosing the impellers.

The impellers have an inlet or an eye towards the radial center portion around the drive shaft. Spinning the impeller creates centrifugal forces on the fluid in the impeller. The centrifugal forces increase the velocity of the fluid in the impeller as the fluid is propelled towards the tubular housing.

The height that the fluid would be able to travel in a passageway extending vertically from the exit of the impeller is the head generated from the impeller. A large amount of head is necessary in order to pump the well fluid to the surface. Either increasing the impeller diameter or increasing the number of impellers can increase the amount of head generated by a pump. The diameter of the impellers is limited by the diameter of the well assembly. Therefore, increasing the number of impellers is the common solution for downhole pumps in order to generate enough head to pump the well fluid to the surface.

The fluid enters a stationary diffuser after exiting the impeller. The fluid loses velocity in the diffuser because it is stationary. Decreasing the velocity of the fluid in the diffuser causes the pressure of the fluid to increase. The diffuser also redirects the fluid to the eye or inlet of the next impeller. Each impeller and diffuser is a stage in a pump. The pressure increase from one stage is additive to the amount of head created in the next stage. After enough stages, the cumulative pressure increase on the well fluid is large enough that head created in the last impeller pumps the well fluid to the surface.

Each impeller mounts directly to the drive shaft, but the diffusers slide over the drive shaft and land on the diffuser of the previous stage. A pre-load is applied so that this contact between the diffusers creates a large enough frictional force to prevent the diffusers from spinning with the drive shaft. Under some operating conditions, the temperature of the well fluid is cool enough to cause the material of the diffusers to shrink. Shrinkage in the material of the diffusers may cause gaps to form between diffuser interfaces and a loss in the frictional resistance to spin.

The pressure does not increase between stages when the diffusers are not stationary. The pump will not be capable of generating enough head to pump the well fluid to the surface when each stage does not increase the pressure.

Furthermore, if the diffusers do not allow the fluid velocity to decrease between stages, the intake velocity of the fluid in the next stage may cause serious performance problems. These problems can cause drive shaft vibrations large enough to damage the pump. Methods of applying pre-loads to the diffusers are known in the art, but the known methods cannot provide additional forces on the diffusers in case the temperature of the fluid causes the diffusers to shrink during operation.

SUMMARY OF THE INVENTION

A first compressive device provides a pre-compressive load on the stack of diffusers. This pre-compressive load prevents the diffusers from rotating with the drive shaft and impellers by insuring that the resistance to slippage at diffuser interfaces is too large for the drive shaft and impellers to overcome. A spring member provides additional compressive forces on the stack of diffusers. The pre-compressive load from the first compressive device holds the diffusers stationary relative to the rotating shaft and impellers under normal operating conditions. The spring member becomes the primary compressive force only at times when the first compressive device fails to compress the stack of diffusers.

Such an event may occur when the material of the diffusers shrinks because the diffusers cool down when in contact with well fluid that is cooler in temperature than normal. The shrinkage in the dimensions of the diffusers causes gaps to form between the diffusers. The first compressive device cannot be adjusted to a different position during operation. Therefore, there is no frictional force resisting slippage because of the gaps at the interfaces of the diffusers. Accordingly, the diffusers could rotate with the impellers and drive shaft. However, the spring member provides an additional force that can continue to apply a compressive load on the stack of diffusers even after cooler well fluid causes the diffusers to shrink. The compressive force from spring member closes any gaps that would form, and insures that there is a slip resisting frictional force at the diffuser interfaces.

Preventing any formation of gaps between diffusers with the spring member prevents the diffusers from rotating with the drive shaft and impellers. Having stationary diffusers allows the velocity of the well fluid to decrease, which in turn causes the pressure of the well fluid to increase. Decreasing the well fluid velocity and increasing the well fluid pressure is necessary for generating the necessary head to pump the well fluid to the surface. Furthermore, diffuser rotation accelerates wear which increases the running clearances between the diffusers and impellers, which may damage the pump. Preventing diffuser rotation helps to maintain the running clearances between the impellers and diffusers, thereby protecting the pump from damage. By maintaining the design operating conditions and running clearance of the pump, the spring member prevents cooler temperature well fluids from damaging the pump, and the spring member prevents production disruptions by maintaining well fluid flow to the surface.

DETAILED DESCRIPTION OF THE PREFERRED EMBODIMENTS

Figure 1:
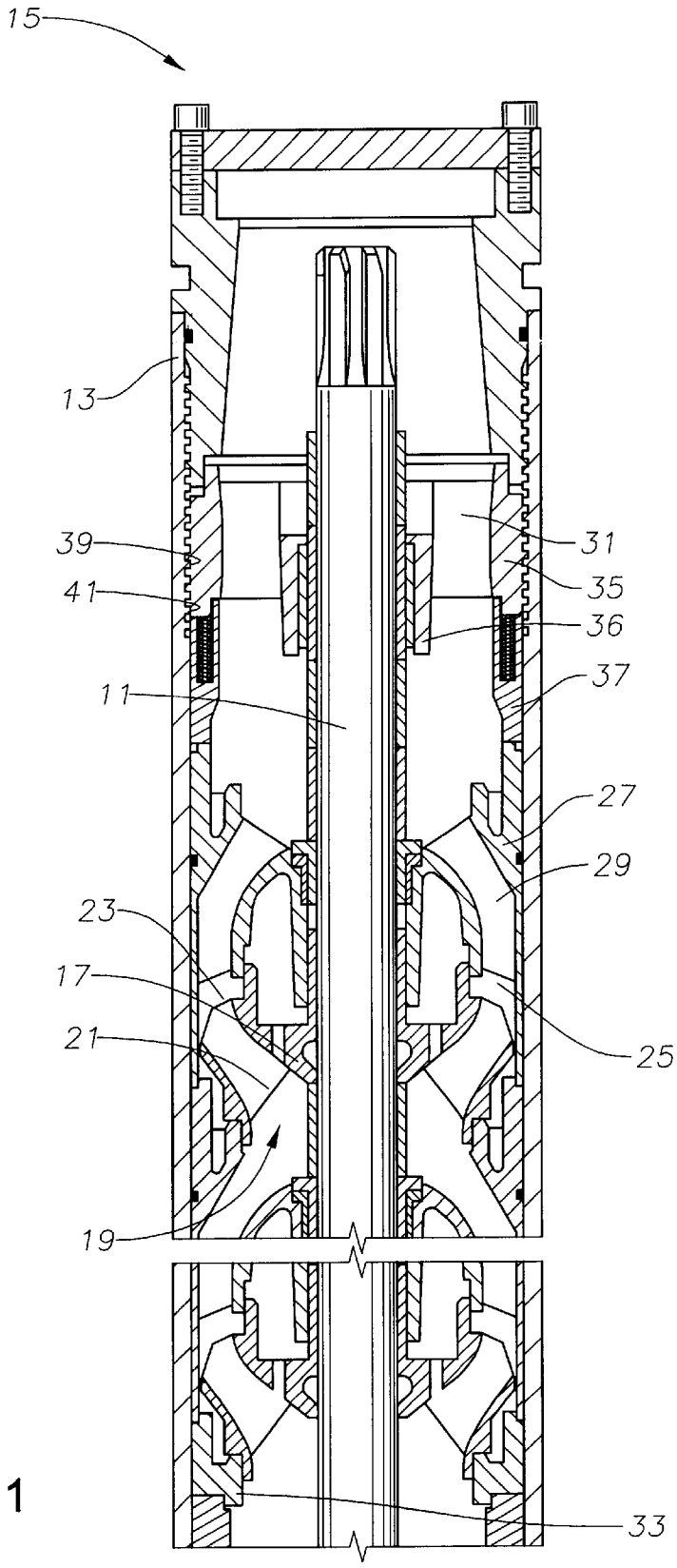
FIG. 1 is a cross-sectional view of a downhole centrifugal pump constructed in accordance with this invention.

Referring to FIG. 1, a drive shaft 11 extends axially through the approximate centerline of a tubular housing 13 of a centrifugal pump 15. In the preferred embodiment, pump 15 is lowered into the well on a string of tubing (not shown). Pump 15 discharges the well fluids up the string of tubing to the surface. A plurality of impellers 17 are axially mounted to drive shaft 11. An inlet eye 19 on each impeller 17 located at the inner portion of each impeller is oriented downward in order to receive the well fluid from below. A set of impeller vanes 21 is in fluid communication with inlet eye 19. Vanes 21 redirect the well fluid from traveling up the center of pump 15 along drive shaft 11 radially towards tubular housing 13 surrounding impellers 17. Vanes 21 increase the velocity of the well fluid flowing through impeller 17 as impeller 17 rotates.

An outlet 23 discharges the well fluid out of the radially outermost portions of impeller 17. A diffuser inlet 25 is in fluid communication with each impeller outlet 23. The well fluid enters a diffuser 27 through diffuser inlet 25. Diffuser 27 is stationary, so the velocity of the well fluid decreases while passing through diffuser 27. The well fluid pressure increases proportionally to the decrease in well fluid velocity. Impeller 17 and diffuser 27 define a pump stage. Additional pump stages are combined in series until the cumulative pressure from the series of pump stages creates enough head to force the well fluid to the surface. Head is the distance the fluid will travel vertically up a pipe after passing through a pump stage.

Diffuser 27 has diffuser vanes 29 which define passages inside of diffuser 27 that carry the well fluid radially inward towards drive shaft 11. Diffuser vanes 29 are in fluid communication with impeller inlet eye 19 of the next pump stage in pump 15. The centrifugal forces from impeller 17 of the next stage increases the velocity of the well fluid and diffuser 27 translates the increase in velocity into an increase in well fluid pressure when diffuser 27 allows the well fluid velocity to decrease. Impellers 17 and diffusers 27 continue to increase and decrease the velocity of the well fluids until the head from the cumulative well fluid pressure is large enough for the well fluid to communicate to the surface. Pump outlets 31 discharge the pressurized well fluid into the string of tubing (not shown) for the well fluids to flow up the well to the surface.

The pump assembly is made by stacking a series of pump stages on top of each other. Each impeller 17 engages drive shaft 11 through a hub and key that insures that each impeller 17 rotates with drive shaft 11. Diffusers 27 slide over drive shaft 11 until the radially outermost portion of the lowest diffuser 27 lands on a spacer 33. The other diffusers 27 land on the upper portion of diffuser 27 directly below. Spacer 33 is a tubular structure that extends up from below the first pump stage. Diffusers 27 do not contact drive shaft 11 or impellers 17.

A first compressive device 35 compresses the stages of pump 15 so that diffusers 27 do not rotate with the rotations of drive shaft 11 and impellers 17. Compression prevents diffuser 27 rotation due to the resistance to slippage from static friction at the interfaces of diffusers 27 in the stack of stages, which are large enough to prevent diffuser 27 slippage while drive shaft 11 rotates. In the embodiment shown in FIG. 1, first compressive device 35 is located above the stack of diffusers 27. Alternatively, first compressive device 35 can be located below the stack of diffusers 27. An anti-spin adapter 37, which is located between first compressive device 35 and the uppermost diffuser 27, communicates the compressive forces from first compressive device 35 to the stack of diffusers 27.

Figure 2:
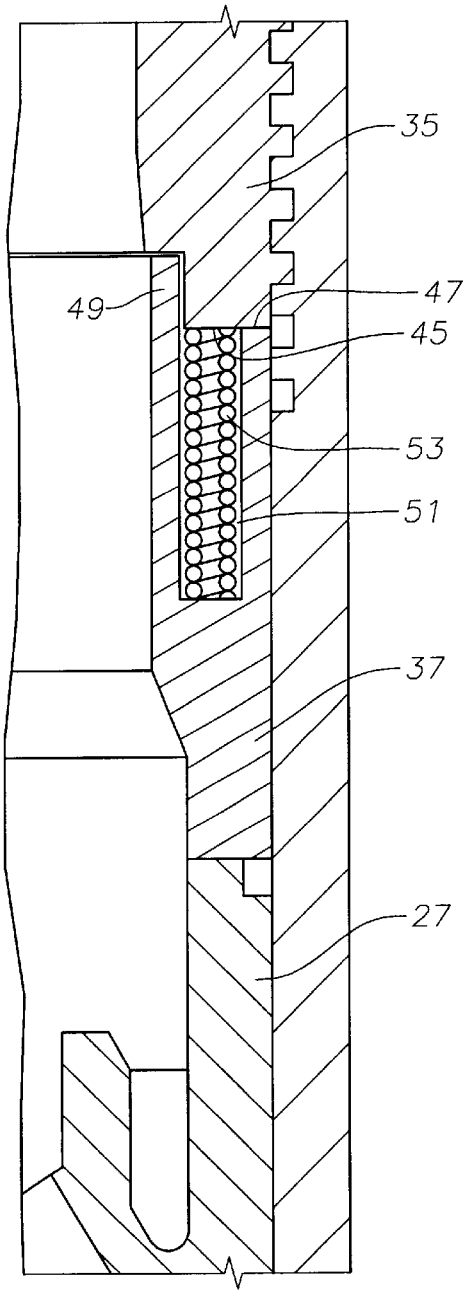
FIG. 2 is an enlarged cross-sectional view of a portion of the pump in FIG. 1.

In the preferred embodiment, first compressive device 35 includes the outer portion of a tubular bearing 36 that slidingly receives drive shaft 11. Threads 39 are formed on the upper outer circumference of first compressive device 35. Threads 39 matingly engage threads 41 formed on the inside surface of tubular housing 13. Referring to FIG. 2, a downward facing shoulder 45 is located on the lower end of first compressive device 35. A load shoulder 47 is located on the upper portion of adapter 37. Load shoulder 47 is located on the radially outermost portion of adapter 37 and is engaged by shoulder 45 of first compressive device 35. Compressive forces pass from first compressive device 35 to adapter 37 through the interface between shoulder 45 and load shoulder 47.

The lower end of adapter 37 engages the uppermost portion of uppermost diffuser 27. In an alternative embodiment (not shown), adapter 37 engages the lowermost portion of the lowermost diffuser 27 when first compressive device 35 is below the stack of diffusers 27. Tightening first compressive device 35 towards diffusers 27 creates a pre-load compressive force that passes from first compressive device 35 through adapter 37 to diffusers 27. The pre-load compressive force is large enough to hold diffusers 27 stationary relative to rotating drive shaft 11 and impellers 17 due to the frictional resistance to slippage at the interfaces of diffusers 27.

A lip 49 protrudes from adapter 37 towards first compressive device 35 so that lip 49 extends alongside the radially innermost surface of first compressive device 35. At least one cavity 51 is defined between the inner surface of adapter load shoulder 47 and lip 49 on the upper end of adapter 37. Cavity 51 could be a plurality of cylindrical holes spaced around the circumference of adapter 37 or it could be a single annular cavity. A second compressive device 53, which is preferably a spring member, sits in cavity 51. Spring member 53 can be a Belleville spring, a wave spring, or a plurality of coil springs. Spring member 53 rests in cavity 51 and in its natural state protrudes farther towards first compressive device 35 than adapter load shoulder 47. Spring member 53 engages shoulder 45 when first compressive device 35 engages adapter 37. Spring member 53 engages shoulder 45 prior to adapter load shoulder 47 engaging shoulder 45. Therefore, shoulder 45 must compress spring member 53 in order to engage adapter load shoulder 47.

Spring member 53 does not provide primary compressive forces through adapter 37 on diffusers 27 under normal operating conditions. Under normal operating conditions the load path bypasses spring member 53 from first compressive device 35 through adapter 37 to diffusers 27. Spring member 53 provides the primary compressive force through adapter 37 on diffusers 27 under certain operating conditions. For example, when the temperature of the well fluid is cool enough to cause the material of diffusers 27 to shrink, gaps may form between diffuser 27 and adapter 37. If gaps form between diffuser 27 and adapter 37 after first compressive device 35 is tightened down, then diffusers 27 would have no more compressive force to resist slippage at the interfaces of diffusers 27. Diffusers 27 may begin to rotate without spring member 53 providing a second compressive force on adapter 37. Rotating diffusers 27 prevent the well fluids from decreasing in velocity, which has two effects. First, the well fluid pressure does not increase before entering the next impeller 17. Second, impellers 17 and diffusers 27 can have accelerated wear which can cause damage to pump 13.

Figure 3:
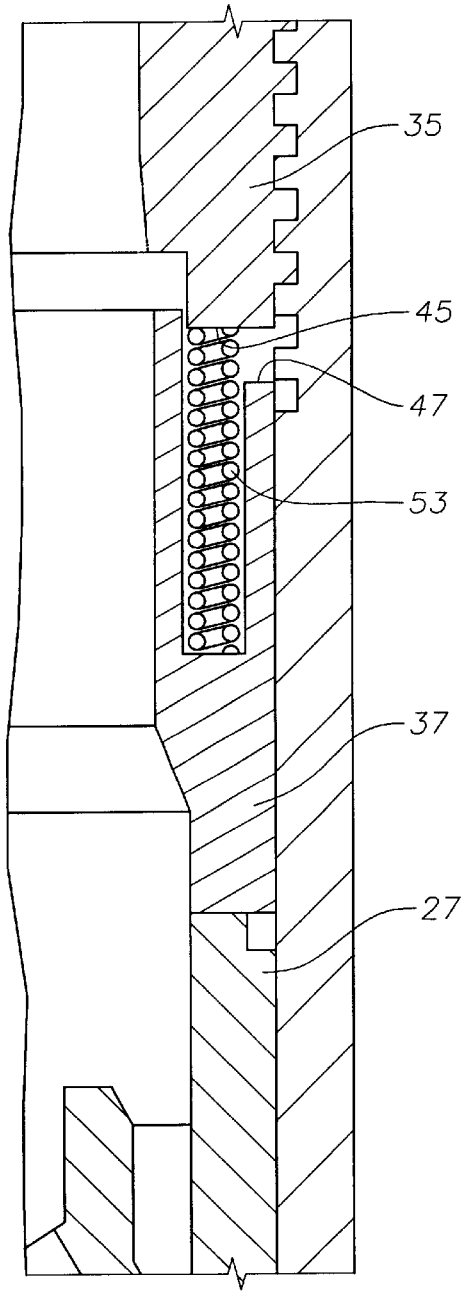
FIG. 3 is a view similar to FIG. 2, but showing the second compressive device providing a compressive force.

Referring to FIG. 3, when a gap forms between shoulders 45 and 47 of first compressive device 35 and adapter 37, spring member 53 continues to exert a compressive force on adapter 37, thereby closing any gaps between diffusers 27. Diffusers 27 will not rotate with drive shaft 11 (shown in FIG. 1) and impellers 17 (shown in FIG. 1) when sufficient pre-load compressive force is applied by spring member 53.

During assembly, a spacer 33 is slid over drive shaft 11 inside of pump housing 13. Impellers 17 and diffusers 27 are alternately slid over and mounted on drive shaft 11. The hubs of impellers 17 engage drive shaft 11 so that impellers 17 rotate with drive shaft 11. The first diffuser 27 lands on and engages spacer 33 so that diffuser 27 neither contacts drive shaft 11 nor impeller 17. Additional impellers 17 and diffusers 27 are stacked on top of the first impeller 17 and diffuser 27 until the desired number of stages are present.

Adapter 37 slides over drive shaft 11 and engages the radially outermost and uppermost portion of the uppermost diffuser 27. Spring member 53 is located in cavity 51 of adapter 37 between lip 49 and load shoulder 47, and protruding above load shoulder 47. First compressive device 35 slides over drive shaft 11 with shoulder 45 engaging shoulder 47 of adapter 37 and spring member 53. Shoulder 45 engages adapter load shoulder 47. First compressive device 35 applies a pre-load force through adapter 37 to diffusers 27 when threads 39 of first compressive device 35 are rotatably tightened into housing threads 41. Shoulder 45 also compresses spring member 53.

The pre-load force from first compressive device 35 is large enough to prevent slippage at diffuser 27 interfaces, therefore preventing diffusers 27 from rotating with drive shaft 11 and impellers 17. Spring member 53 provides a primary compressive force on diffusers 27 through adapter 37 if the well fluid communicating through diffusers 27 is cold enough to cause a gap to form between shoulders 45 and 47 when diffuser 27 material shrinks. First compressive device 35 and spring member 53 work in conjunction with each other to insure that diffusers 27 remain stationary relative to drive shaft 11 and impellers 17. Stationary diffusers 27 allow the pressure of the well fluids to increase as the velocity of the well fluids decrease. Increasing the well fluid pressure while at the same time decreasing the well fluid velocity maintains the designed operating conditions of pump 15. Operating within the design conditions of pump 15 prevents drive shaft 11 vibrations, which will cause damage to pump 15.

Further, it will also be apparent to those skilled in the art that modifications, changes and substitutions may be made to the invention in the foregoing disclosure. Accordingly, it is appropriate that the appended claims be construed broadly and in the manner consisting with the spirit and scope of the invention herein. For example a cavity could be located in compressive device 35 so that spring member 53 rests in and extends from compressive device 35 instead of resting in cavity 51 and extending from adapter 37. Furthermore, if a cavity were in compressive device 35 instead of adapter 37, an adapter may not be necessary.

What is claimed is:

1. A pump comprising:

a tubular housing;

a plurality of pump stages mounted in the housing, each having an impeller and a diffuser, the diffusers being stacked one on another in a stack within the housing;

a first compressive device which applies a pre-compressive force on the stack of diffusers during operation of the pump, holding the diffusers stationary relative to impellers; and a spring member which applies a compressive force on the stack of diffusers to hold the diffusers stationary relative to the impellers in the event the first compressive device ceases to apply the pre-compressive force, and wherein a load path during operation of the pump from the first compressive device to the stack of diffusers bypasses the spring member.

2. The pump of claim 1, wherein the spring member is compressed against the stack of diffusers during operation of the pump, even when the first compressive device is applying the pre-compressive force, and wherein the first compressive device comprises a threaded member that is rotated to a selected position to apply the pre-compressive force and remains in the selected position during operation of the pump.

3. The pump of claim 1, further comprising an adapter located between the first compressive device and the stack of diffusers, and wherein the first compressive device comprises a threaded member that passes the pre-compressive force to the stack of diffusers during operation of the pump through the adapter.

4. The pump of claim 1, further comprising an adapter in contact with both the first compressive device and spring member, the adapter being located between the stack of diffusers and the first compressive device and also being located between the stack of diffusers and the spring member, and wherein the first compressive device comprises a threaded member.

5. A pump comprising:

a tubular housing;

a plurality of pump stages mounted in the housing, each having an impeller and a diffuser, the diffusers being stacked one on another in a stack within the housing;

a first compressive device which applies a pre-compressive force on the stack of diffusers, holding the diffusers stationary relative to impellers;

a spring member which applies a compressive force on the stack of diffusers to hold the diffusers stationary relative to the impellers in the event the first compressive device ceases to apply the pre-compressive force, and wherein a load path from the first compressive device to the stack of diffusers bypasses the spring member;

a drive shaft running axially through the pump housing, the plurality of stages being mounted along a portion of the drive shaft, a portion of the inner surface of the tubular housing having threads;

and, wherein the first compressive device comprises a drive shaft bearing having threads extending around a circumference of the bearing that engage the threads on the tubular housing.

6. A pump comprising:

a tubular housing;

a plurality of pump stages mounted in the housing, each having an impeller and a diffuser, the diffusers being stacked one on another in a stack within the housing;

a first compressive device which applies a pre-compressive force on the stack of diffusers, holding the diffusers stationary relative to impellers;

a spring member which applies a compressive force on the stack of diffusers to hold the diffusers stationary relative to the impellers in the event the first compressive device ceases to apply the pre-compressive force, and wherein a load path from the first compressive device to the stack of diffusers bypasses the spring member;

wherein the first compressive device comprises a tubular member secured by threads in the housing and having a load transmitting shoulder;

wherein the pump further comprises:

an adapter located between the stack of diffusers and the first compressive device, the adapter having a load receiving shoulder that is engaged by the load transmitting shoulder during normal operation; and the spring member is located adjacent the load receiving shoulder and in contact with the load transmitting shoulder.

7. A pump comprising:

a tubular housing;

a plurality of pump stages mounted in the housing, each having an impeller and a diffuser, the diffusers being stacked one on another in a stack in the housing;

an anti-spin adapter having one end in contact with the stack of diffusers, the adapter having a load receiving shoulder formed on another end;

a first compressive device having a load transmitting shoulder which engages and applies a compressive force on the load receiving shoulder of the adapter during operation of the pump in order to create a primary compressive force on the stack of diffusers, holding the diffusers stationary relative to the rotating shaft and impeller; and a spring mounted between the first compressive device and the adapter and spaced radially from the load receiving shoulder to apply a force on the adapter in the event that the transmitting and receiving load shoulders cease to engage each other during operation of the pump.

8. A pump comprising:

a tubular housing;

a plurality of pump stages mounted in the housing, each having an impeller and a diffuser, the diffusers being stacked one on another in a stack in the housing;

an anti-spin adapter having one end in contact with the stack of diffusers, the adapter having a load receiving shoulder formed on another end;

a first compressive device having a load transmitting shoulder which engages and applies a compressive force on the load receiving shoulder of the adapter in order to create a primary compressive force on the stack of diffusers, holding the diffusers stationary relative to the rotating shaft and impeller; and a spring mounted between the first compressive device and the adapter and spaced radially from the load receiving shoulder to apply a force on the adapter in the event that the transmitting and receiving load shoulders cease to engage each other; wherein the first compressive device comprises a bearing having threads extending around a circumference of the bearing that engage the threads on the tubular housing, the shoulder of the first compressive device being on the portion of the tubular section closest to the stack of diffusers;

and wherein the pump further comprises:

a drive shaft running axially through the pump housing, the plurality of stages being mounted along a portion of the drive shaft, a portion of the inner surface of the tubular housing having threads.

9. A pump comprising:

a tubular housing;

a plurality of pump stages mounted in the housing, each having an impeller and a diffuser, the diffusers being stacked one on another in a stack in the housing;

an anti-spin adapter having one end in contact with the stack of diffusers, the adapter having a load receiving shoulder formed on another end;

a first compressive device having a load transmitting shoulder which engages and applies a compressive force on the load receiving shoulder of the adapter in order to create a primary compressive force on the stack of diffusers, holding the diffusers stationary relative to the rotating shaft and impeller;

a spring mounted between the first compressive device and the adapter and spaced radially from the load receiving shoulder to apply a force on the adapter in the event that the transmitting and receiving load shoulders cease to engage each other; and wherein the spring is located radially inward of the load receiving shoulder of the adapter.

10. A pump comprising:

a tubular housing;

a plurality of pump stages mounted in the housing, each having an impeller and a diffuser, the diffusers being stacked one on another in a stack in the housing;

an anti-spin adapter having one end in contact with the stack of diffusers, the adapter having a load receiving shoulder formed on another end;

a first compressive device having a load transmitting shoulder which engages and applies a compressive force on the load receiving shoulder of the adapter in order to create a primary compressive force on the stack of diffusers, holding the diffusers stationary relative to the rotating shaft and impeller;

a spring mounted between the first compressive device and the adapter and spaced radially from the load receiving shoulder to apply a force on the adapter in the event that the transmitting and receiving load shoulders cease to engage each other; and a cavity radially inward from the load receiving shoulder for receiving the spring.

11. The pump according to claim 10, further comprising a lip radially inward from the cavity that extends axially past the load receiving shoulder.

12. The pump of claim 11, wherein the cavity is in the adapter and the lip is on the adapter.

13. A pump comprising:

a tubular housing;

a plurality of pump stages mounted in the housing, each having an impeller and a diffuser, the diffusers being stacked one on another in a stack in the housing;

an anti-spin adapter having one end in contact with the stack of diffusers, the adapter having a load receiving shoulder formed on another end;

a drive shaft running axially through the pump housing, the plurality of stages being mounted along a portion of the drive shaft;

a bearing that provides radial support for the shaft, the bearing having an outer portion that is secured by threads in the housing;

a load transmitting shoulder on the bearing which engages and applies a compressive force on the load receiving shoulder of the adapter in order to create a primary compressive force on the stack of diffusers, holding the diffusers stationary relative to the rotating shaft and impeller, the load transmitting shoulder being on the portion of bearing closest to the stack of diffusers; and a spring compressed between the bearing and the adapter and spaced radially from the load receiving shoulder to apply a force on the adapter in the event that the transmitting and receiving load shoulders cease to engage each other.

14. The pump of claim 13, wherein the spring is located within a cavity radially inward of the load receiving shoulder of the adapter.

15. The pump of claim 13, further comprising a lip located on the radially inwardmost portion of the adapter, which extends axially past the load receiving shoulder;

and wherein:

the spring is located radially inward of the load receiving shoulder of the adapter, and radially outward of the lip of the adapter.

16. A method for preventing a stack of diffusers in a centrifugal pump from spinning, the stack of diffusers being mounted within a tubular housing and containing a plurality of impellers, comprising:

(a) mounting an anti-spin adapter onto one end of the stack of diffusers;

(b) applying a pre-load compressive force along a load path on the stack of diffusers with a first compressive device;

(c) compressing a spring between the first compressive device and the stack of diffusers outside of the load path;

(d) operating the pump by rotating the impellers while continuing to apply the pre-load compressive force; and (e) in the event the first compressive device ceases applying the compressive force on the stack of diffusers during operation of the pump, continuing to apply a compressive force on the stack of diffusers with the spring.

17. The method according to claim 16, wherein step (d) comprises applying the pre-load compressive force along a load path that bypasses the spring.

* * * * *